US006793462B2

(12) United States Patent
Smekal et al.

(10) Patent No.: US 6,793,462 B2
(45) Date of Patent: Sep. 21, 2004

(54) FLUIDIC PUMP

(75) Inventors: Thomas J. Smekal, Phoenix, AZ (US); Piotr Grodzinski, Chandler, AZ (US); David B. Rhine, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/202,976

(22) Filed: Jul. 25, 2002

(65) Prior Publication Data

US 2004/0018095 A1 Jan. 29, 2004

(51) Int. Cl.[7] ..... F04B 3/00

(52) U.S. Cl. ..... 417/118; 417/379; 422/123; 422/305; 204/278; 204/266; 205/628

(58) Field of Search ..... 417/53, 118, 379; 422/120, 123, 305; 204/278, 266; 205/628

(56) References Cited

U.S. PATENT DOCUMENTS 3,727,058 A * 4/1973 Schrey ..... 250/352
3,894,538 A * 7/1975 Richter ..... 604/891.1
3,963,596 A * 6/1976 Kircher ..... 204/258
4,522,698 A * 6/1985 Maget ..... 204/265
4,800,163 A * 1/1989 Hibi et al. ..... 435/285.2
5,398,851 A * 3/1995 Sancoff et al. ..... 222/386.5
5,423,454 A * 6/1995 Lippman et al. ..... 222/1
5,681,435 A * 10/1997 Joshi et al. ..... 204/266
5,685,966 A * 11/1997 Aaron et al. ..... 204/600
5,989,407 A * 11/1999 Andrews et al. ..... 205/626
6,224,728 B1 * 5/2001 Oborny et al. ..... 204/450
6,387,228 B1 * 5/2002 Maget ..... 204/230.2
6,425,440 B1 * 7/2002 Tsenter et al. ..... 165/104.12
2002/0100682 A1 * 8/2002 Kelley et al. ..... 204/266

OTHER PUBLICATIONS

"A closed–loop controlled electrochemically actuated micro–dosing system," Bohm et al., J. Micromech. Microeng. 10 (2000), pp. 498–504.

* cited by examiner

*Primary Examiner*—Justine R. Yu
*Assistant Examiner*—Emmanuel Sayoc
(74) *Attorney, Agent, or Firm*—William E. Koch

(57) ABSTRACT

A fluidic pump (108) comprises an electrolyte cavity (110) and a pump outlet (115) fluidically coupled to the electrolyte cavity that are within at least a portion of a fluid guiding structure (105), two electrodes (112, 113) extending from the fluid guiding structure into the electrolyte cavity; and a vapor permeable membrane (120) that prevents an electrolyte (125) in the electrolyte cavity from passing through the pump outlet while allowing gas to flow through the pump outlet.

3 Claims, 2 Drawing Sheets

FLUIDIC PUMP

FIELD OF THE INVENTION

This invention relates generally to fluid pumps, and in particular to a fluid pump for a small fluidic system such as a biological assaying system.

BACKGROUND OF THE INVENTION

The ability to pump and manipulate small volume of fluids at a relatively high flow is an integral part of almost any microfluidic device. Examples of microfluidic devices are those intended for use in sample preparation, synthesis, and screening, and are capable of sample pre-contretation, amplification, hybridization and separation. Microfluidic devices of these types are being designed and fabricated to manipulate fluids in ultra small volumes, i.e. tens of microliters or less. In many applications, such as biological sample analysis, desirable attributes for the microfluidic device, and therefore the fluid pump, are inexpensiveness, small size, sufficient capacity, and low power requirements. Inexpensiveness is desirable for its marketing advantage and so that the microfluidic device is economically disposable. Small size is desirable for compatibility with the rest of the microfluidic system and also for efficiency of bench space, particularly when many disposable microfluidic devices are operated simultaneously. Sufficient capacity is meant to combine the features of sufficient pressure and flow volume to operate a microfluidic device, or an adequate portion of a microfluidic device. Low power is desirable for portability and also to avoid undesirable heating of the fluid being tested. Conventional types of small fluid pumps are not known with all of these features. For example, an air pump that is activated by heating the air requires a relatively large amount of heat and can be too large.

BRIEF DESCRIPTION OF THE DRAWINGS

The present invention is illustrated by way of example and not limitation in the accompanying figures, in which like references indicate similar elements, and in which.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE DRAWINGS

Figure 1:
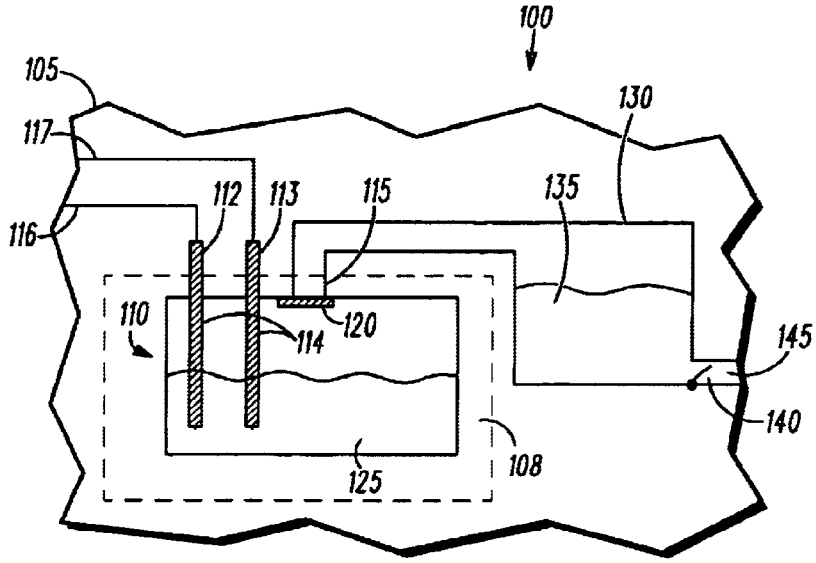
FIG. 1 is a mechanical cross-sectional drawing of a fluidic system that includes a fluidic pump, in accordance with the preferred embodiment of the present invention.

Referring to FIG. 1, a mechanical cross-sectional drawing of a fluidic pump 108 is shown, in accordance with the preferred embodiment of the present invention. The fluidic pump 108 comprises a portion of a fluid guiding structure 105 that has an electrolyte cavity 110, two electrodes 112, 113, and a vapor permeable membrane 120. The fluid guiding structure 105 is preferably made of plastic. The electrolyte cavity 110 has a pump outlet 115 for gases emitted by an electrolytic substance 125 that can be placed in the electrolyte cavity 110 at the time of fabrication of the fluidic pump 108, or at a later time by means such as pipetting. The electrolytic substance 125 is characterized by being a liquid substance that generates a gas when current flows between the electrodes 112, 113, and is preferably a water-based solution. The vapor permeable membrane 120 is made of a material that prevents the electrolytic substance 125 from passing through the pump outlet 115, while at the same time allowing gas to flow through the pump outlet 115. In other words, the vapor permeable membrane 120 separates the electrolytic substance 125 from the pump outlet 115. A preferred material for the vapor permeable membrane is a hydrophobic material, such as a Sure Vent PVDF membrane made by Millipore Corp. of Bedford, Mass., having a pore size of 0.65 micrometers, for an electrolytic substance 125 that is salt water. The electrodes 112, 113 are coupled to a source of direct current by conductors 116, 117. When a direct current is caused to flow through the electrolytic substance 125, gas is generated that flows out of the pump outlet 115. The pump outlet 115 is fluidically coupled to an object cavity 130. In this example, the gas pushes an object fluid 135 located in an object cavity 130 through a fluidic output channel 145 that is coupled to the object cavity 130 (while valve 140 is open). In this example, the object cavity 130, the object fluid 135, the valve 140, and the fluidic output channel 145 are within the fluid guiding structure 105, but they need not be. For example, the fluidic pump 108 could comprise all of the fluid guiding structure 105 and the pump outlet 115 could be coupled by an external fluidic channel to another fluidic structure housing the object fluid. In accordance with the preferred embodiment, the electrodes 112, 113 are solid platinum, at least for those portions of the electrodes 112, 113 that contact the electrolytic substance 125. In an alternative embodiment, the electrodes 112, 113 are plated with platinum 114, over at least those portions of the electrodes 112, 113 that contact the electrolytic substance 125.

In this example of the fluidic pump 108, the pump is designed for operation in a gravitational field and the pump outlet 115 is located atop the electrolyte cavity 110; that is to say, the pump outlet is located on a portion of the electrolyte cavity that is above the fluid level of the electrolytic substance 125 when the fluidic structure is oriented in an intended direction with reference to gravity. If the orientation of the fluidic pump 108 is likely to change during the operation of the fluidic pump 108, then the vapor permeable membrane 120 could be a plurality of membranes located at a plurality of holes around the pump cavity, or a single vapor permeable membrane covering the plurality of holes, and a chamber could couple the plurality of holes to the pump outlet 115.

Figure 2:
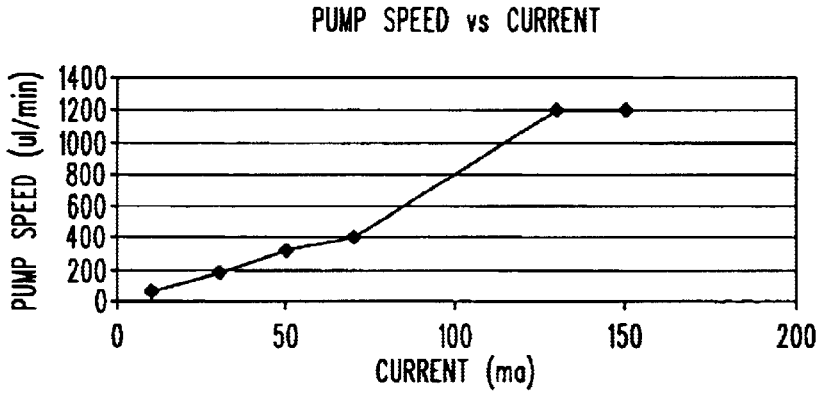
FIG. 2 is a graph showing fluidic pump output versus input current for an exemplary fluidic pump fabricated in accordance with the preferred embodiment of the present invention.

Referring to FIG. 2, a graph shows fluidic pump output versus input current, for an exemplary fluidic pump 108 fabricated in accordance with the preferred embodiment of the present invention. In this example a salt water electrolytic solution is placed in an electrolyte cavity 110 having a capacity of When direct electric potential is applied across the electrodes 112, 113, a direct current flows through the electrolytic solution, producing oxygen and hydrogen in a quantity at pressures sufficient to pump 60 microliters of an object fluid at rates indicated by the graph. It can be seen that the pump of this example can pump the 60 microliters of object fluid in durations ranging from 3 (at 1200 microliters per minute) seconds to 48 seconds (at 70 microliters per second. It will be appreciated that the minimum electrolytic cavity volume is directly related to the minimum amount of electrolyte needed to produce the gas needed to pump the desired amount of object fluid.

Figure 3:
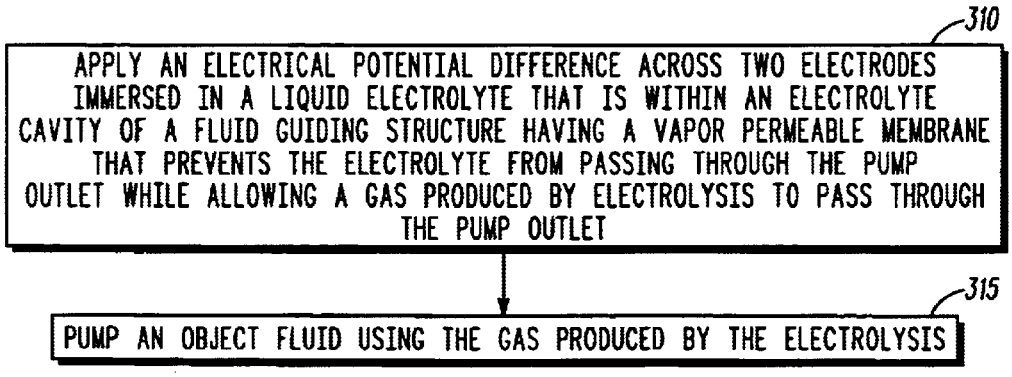
FIG. 3 is a flow chart showing operation of a fluidic pump.
Figure 4:
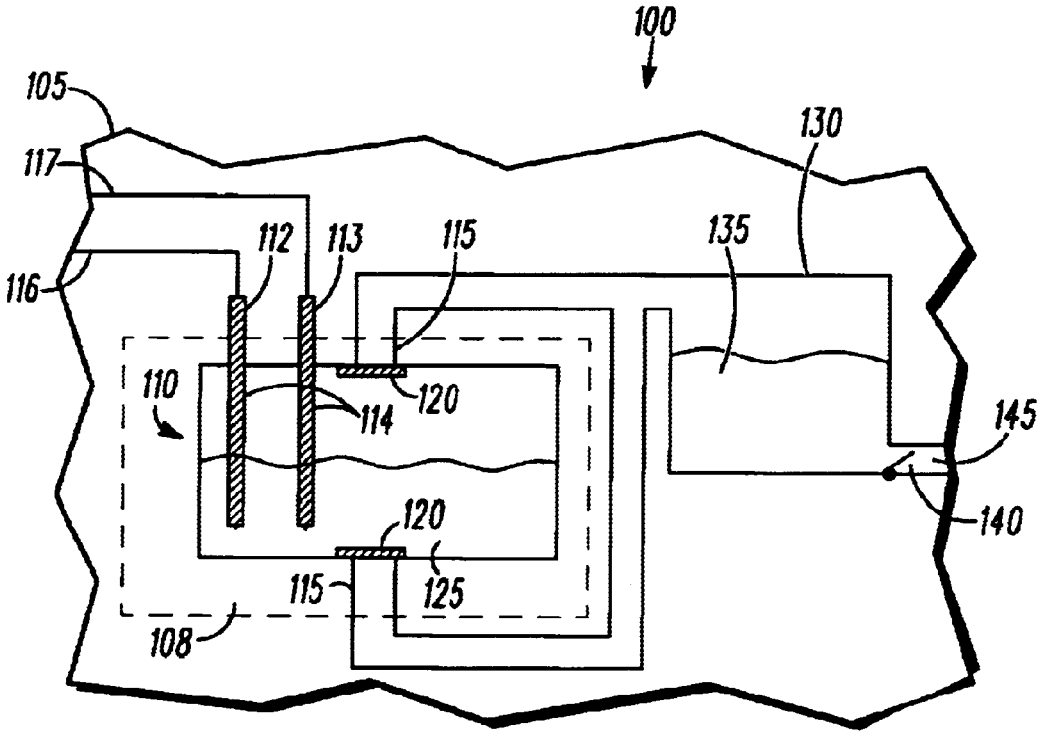
FIG. 4 is a mechanical cross-sectional drawing of a fluidic system that includes a fluidic pump, in accordance with another embodiment of the present invention.

Referring to FIG. 3, a flow chart shows a method of pumping an object fluid. At step 310 an electrical potential difference is applied across two electrodes 112, 113 immersed in a liquid electrolyte 125 that is within an electrolyte cavity 110 of a fluid guiding structure 105 having a vapor permeable membrane 120 that prevents the liquid electrolyte 125 from passing through the pump outlet 115 while allowing a gas produced by electrolysis to pass through the pump outlet 115. In step 315, the gas produced at the pump outlet 115 pumps the object fluid 135 in the object cavity 130.

It will be appreciated that the fluidic pump in accordance with the present invention is small, has low power requirements, and is inexpensive. It is very well suited for pumping small amounts of gas in ranges from nanoliters to milliliters and is therefore ideally suited for such fluidic systems as biological sample analysis systems that use disposable sample analysis modules. In such systems, it can be used to push the sample into a mixing chamber for mixing with another fluid, and then pushing the resultant mixture into an analysis chamber.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fluidic pump having a fluidic outlet, comprising:

an electrolyte cavity for containing an electrolyte, the electrolyte cavity including at least two pump outlets located on separate sides of the said electrolyte cavity;

two electrodes extending into the electrolyte cavity for contacting the electrolyte;

at least two vapor permeable membranes, one each contiguous to one of the pump outlets, that prevents the electrolyte from passing through the pump outlets while allowing gas, produced by the electrolyte in response to on electrical potential difference applied across the two electrodes, to pass through the pump outlets regardless of the fluidic pump's orientation with respect to gravity; and an object cavity for containing a material and coupling to the fluidic outlet, the gas propelling the material through the fluidic outlet.

2. The fluidic pump as claimed in claim 1, where the pump outlets are comprised of a group of at least two holes each.

3. The fluidic pump as claimed in claim 2, wherein a chamber couples the at least two holes to a single pump outlet.

* * * * *